United States Patent [19]

Ohashi et al.

[11] Patent Number: 4,889,749

[45] Date of Patent: Dec. 26, 1989

[54] IDENTIFICATION CARD

[75] Inventors: Masato Ohashi, Sanda City; Shiyoojiro Kodai, Itami City, both of Japan

[73] Assignees: Ryoden Kasei Co., Ltd.; Mitsubishi Denki Kabushiki Kaisha, both of Japan

[21] Appl. No.: 124,557

[22] Filed: Nov. 24, 1987

[30] Foreign Application Priority Data

Dec. 3, 1986 [JP] Japan ..... 61-288098

[51] Int. Cl.[4] ..... A47G 1/12

[52] U.S. Cl. ..... 428/13; 428/68; 428/76; 428/204; 428/209; 428/901; 428/915; 428/911; 428/212; 283/74; 283/75; 283/77; 283/107; 283/109; 283/111

[58] Field of Search ..... 428/13, 915, 916, 204, 428/209, 901, 68, 76, 212; 283/74, 75, 77, 109, 111, 107

[56] References Cited

U.S. PATENT DOCUMENTS

| | | | |
|---|---|---|---|
| 3,512,286 | 5/1970 | Siegel | 283/77 |
| 3,582,439 | 6/1971 | Thomas | 283/77 |
| 4,318,554 | 3/1982 | Anderson et al. | 283/77 |
| 4,330,350 | 5/1982 | Andrews | 283/77 |
| 4,514,785 | 4/1985 | Parmentier | 428/13 |
| 4,589,687 | 5/1986 | Hannon | 283/77 |

FOREIGN PATENT DOCUMENTS

| | | |
|---|---|---|
| 3341115 | 5/1985 | Fed. Rep. of Germany . |
| 0048400 | 10/1972 | Japan . |
| 2112324 | 7/1913 | United Kingdom . |

*Primary Examiner*—Ellis P. Robinson
*Assistant Examiner*—P. J. Ryan
*Attorney, Agent, or Firm*—Leydig, Voit & Mayer

[57] ABSTRACT

An identification card comprises a center core layer, a photograph embedded in the core layer, a first assembly of multiple layers laminated on the upper surface of the core layer and the photograph, and a second assembly of multiple layers laminated on the back surface of the core layer and the photograph. The layers of the first and second assemblies have substantially similar thermal expansion properties. Accordingly, the thickness of the identification card is uniform since the thickness of the core layer is substantially the same as the thickness of the photograph. High reliability can be obtained without any accompanying warp as a result of the substantially symmetrical arrangement of the first and second assemblies with respect to the core layer and the embedded photograph.

8 Claims, 2 Drawing Sheets

IDENTIFICATION CARD

BACKGROUND OF THE INVENTION

This invention relates to an identification (ID) card such as a card with a photograph embedded therein having a magnetic stripe, an IC (integrated circuit) card and the like and more particularly to an identification card in which the flatness and reliability of the ID card are improved.

Conventionally, there have been laminated photographic identification cards (hereinafter abbreviated as photo ID card), for example, driver's licenses. Such cards are fabricated by affixing a photograph on the surface of a card substrate, and laminating a transparent overlay on the surface of the photograph. The card obtained is integrally formed and the photograph is not exposed to the air. Therefore, it is difficult to forge or counterfeit the card. However, the thickness of a conventional ID card is not uniform because of the thickness of the photograph. Therefore, there is a problem in that troubles arise when the thickenss of the ID card must be severely restricted, such as in magnetic striped cards, IC module integrated cards or the like.

In another conventional ID card, a photograph is embedded in the card. Although, this card has a uniform thickness, the portion where the photograph is embedded is liable to warp during use.

FIGS. 1 and 2 are sectional side views showing conventional photo ID cards. In FIG. 1, a photograph 1 is affixed on the surface of a core material 3 of an ID card 10, and an overlay 2 is laminated on the surface of the photograph 1 and on the surface of the core material 3 not covered by the photograph 1. In this case, a portion 20 of the overlay 2 just over the photograph 1 is raised above the surface of the core material 3 by the thickness of the photograph 1.

In FIG. 2, a photograph 1 is embedded in the inside of an ID card 11 adjacent to a core material 3*a* and sandwiched between a core material 3*b* and an overlay 2. In this case, a portion 21 of overlay 2 just over the photograph 1 is not raised above the surface of the card 11. However, since the embedded position of the photograph 1 is close to the surface of the card 11, the card 11 could warp near the portion 21. Further, the warp is increased especially when manufacturing the card 11 by heating and pressing components of the card 11. This is because a material of the photograph 1, which is made of, for example, photographic paper, is different from that of the core material 3*b*, resulting in stress due to the differences in coefficients of thermal expansion between the different materials. The warp generated does not give a desirable an appearance to the card 11. Moreover, the conventional cards 10 and 11 are troublesome in use in an ID card reader or writer apparatus.

FIG. 2 is a plan view showing a conventional magnetic stripe ID card 12. In FIG. 3, a magnetic stripe 6 is affixed on the upper portion of the card 12.

As illustrated in FIG. 3, a photograph 1 affixed on the card 12 for identifying an individual is made of paper or the like, with a thickness in the range of 100 μm to 300 μm.

As mentioned above, there arise problems in that the thickness of conventional ID cards tends to become non-uniform and the cards are liable to warp when they are applied to magnetic striped cards, IC cards or the like.

SUMMARY OF THE INVENTION

Accordingly, an object of the present invention is to provide an identification card in which a photograph is embedded with high reliability and uniform thickness without warp.

In order to achieve the above objects, according to the present invention, there is provided an identification card comprising: a core layer; a photograph embedded in the core layer; a first assembly of multiple layers laminated on the upper surface of the core layer and the photograph; and a second assembly of multiple layers laminated on the back surface of the core layer and the photograph.

In the present invention, a photograph has a thickness which is substantially the same as the thickness of the core layer, and both the photograph and the core layer are substantially symmetrically arranged with respect to the two layer assemblies so that the stress exerted on both sides of the card is balanced to prevent warpage. Moreover, since the photograph is embedded deep in the card, the photograph does not create a bulge in the card.

BRIEF DESCRIPTION OF THE DRAWINGS

The present invention will be more readily apparent from the following detailed description of a few preferred embodiments thereof when taken in conjunction with the accompanying drawings, in which.

DESCRIPTION OF THE PREFERRED EMBODIMENTS

Figure 2:
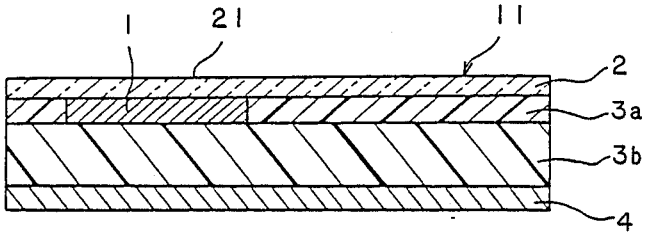
FIG. 2 PRIOR ART
Figure 3:
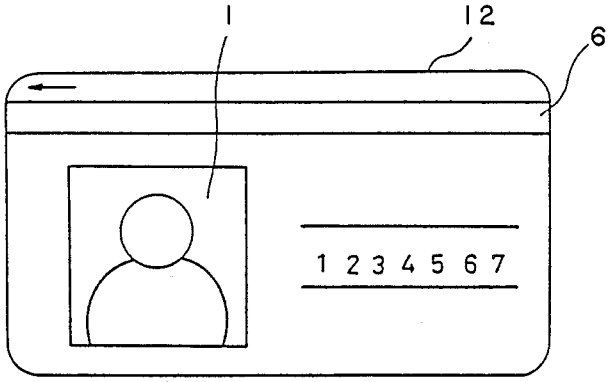
FIG. 3 PRIOR ART
FIG. 3 is a plan view showing a conventional magnetic stripe identification card.

The present invention will be described in detail with reference to presently preferred embodiments thereof as illustrated in FIGS. 4 to 7, where the same reference numerals as in FIGS. 1 to 3 indicate the same or corresponding parts.

Figure 4:
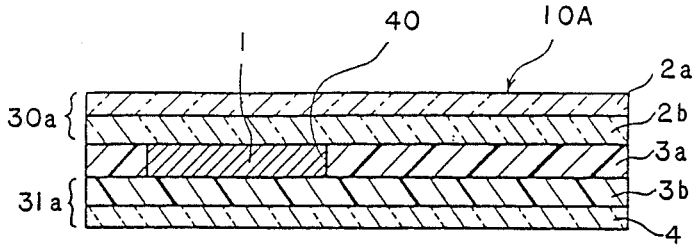
FIGS. 4 to 6 are sectional side views showing an identification card with a photograph embedded therein according to the present invention.

FIG. 4 is a sectional side view showing an identification card with an embedded photograph (hereinafter abbreviated as ID card) according to the first embodiment of the present invention. In FIG. 4, an ID card 10A is provided with five layers, each preferably made of material such as a rigid polyvinyl chloride sheet. In a center core layer 3*a*, a photograph 1 is embedded and surrounded along the edges of an opening 40 made in the core layer 3*a*. A first assembly 30*a* of multiple layers is laminated on the upper surface of the photograph 1 and the core layer 3*a*, and a second assembly 31*a* is laminated on the back surface of the photograph 1 and the core layer 3*a*. The opening 40 has an inside size of substantially equal to the size of the photograph 1 for embedding the photograph 1 therein. The thickenss of the center core layer 3*a* is substantially equal to the thickness of the photograph 1. The first assembly 30*a* includes a transparent sheet 2*b* laminated directly on the upper surface of the core layer and photograph and a surface sheet 2*a* laminated on the transparent sheet 2*b*.

The second assembly 31*a* includes an opaque material 3*b* laminated directly on the back surface of the core layer and photograph and a back material 4 laminated on the the opaque layer 3*b*. The thermal expansion of the first layer assembly 30*a* is substantially the same as that of the second layer assembly 31*a*. All of these sheet materials are laminated in the above manner, then heated, pressed and molded to form the integrated ID card 10A. A design can be disposed on the core layer 3*a* and opague layer 3*b*.

Figure 1:
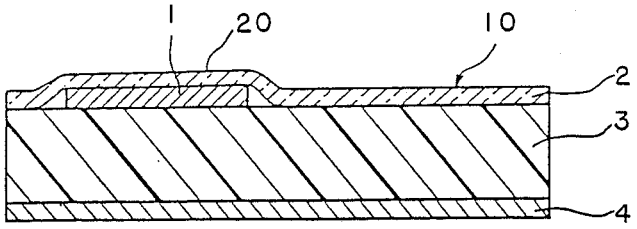
FIG. 1 PRIOR ART
FIGS. 1 and 2 are sectional side views showing a conventional photo identification card.

In the above-mentioned ID card 10A, since the photograph 1 is embedded substantially in the center of the thickness of the card 10A, no bulges, such as portion 20 illustrated in FIG. 1, are created, and since the thickness of the photograph is substantially the same as the thickness of the core layer the thickness of the card 10A can be uniform. Further, although the material of the photograph 1 is different from that of the sheet materials, stresses on both sides of the card 10A are balanced, due to the symmetrical arrangement of the two assemblies having similar thermal expansion properties. As a result warpage is prevented in the card 10A even after the thermal molding process thereof.

Figure 5:
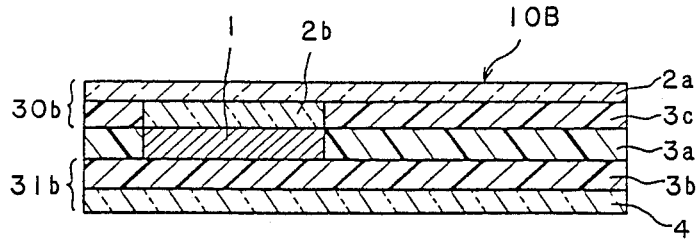

FIG. 5 is a sectional side view showing an ID card according to the second embodiment of the present invention. In FIG. 5, in the same manner illustrated in FIG. 4, a photograph 1 is embedded generally in the middle of the thickness of the card 10B, and a center core layer 3*a* surrounds the photograph 1 along its edges. An opaque sheet 3*c*, instead of a transparent sheet 2*b* as illustrated in FIG. 4, is laminated on the center core material 3*a*. A transparent sheet 2*b* is disposed only above the photograph 1 and is surrounded at its edges by the opaque sheet 3*c*. A surface sheet 2*a* is laminated on the opaque sheet 3*c* and the transparent sheet 2*b*. In this embodiment, the first assemlby 30*b* therefore includes the surface material 2*a*, the opaque sheet 3*c*, and the transparent sheet 2*b*. On the other hand, a core layer 3*b* is laminated on the back surface of the center core layer 3*a* and the photograph 1, and a back material 4 is laminated on the layer 3*b*. In this case, the second layer assembly 31*b* therefore includes the layer 3*b* and the back material 4.

In the above-mentioned card 10B, since the first and second layer assemblies 30*b* and 31*b* are arranged substantially symmetrically with respect to the photograph 1 and core layer 3*a* and have substantially similar thermal expansion properties, the stresses in both layer assemblies 30*b* and 31*b* are more balanced in comparison with the card 10A as illustrated in FIG. 4. Therefore, the generation of warpage is even further prevented. Moreover, since the opaque sheet 3*c*, except for area above photograph 1, is disposed on the card 10B, the card 10B has an improved appearance.

Figure 6:
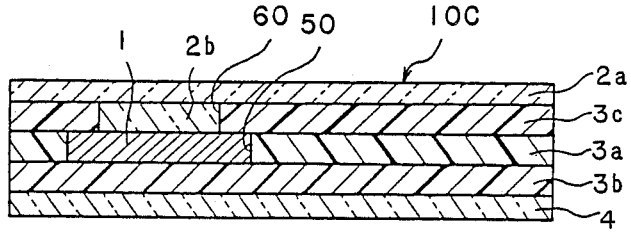

FIG. 6 is a sectional side view showing an ID card according to the third embodiment of the present invention. In FIG. 6, a transparent sheet 2*b*, smaller in size than the photograph 1, is laminated on the photograph 1 of an ID card 10C. The edges of the photograph 1 are sandwiched and fixed by layers 3*c* and 3*b*. Other elements of the card 10C are identical to those of the ID card 10B as illustrated in FIG. 5.

In the above-mentioned card 10C, the seams 50 between the photograph 1 and the center core layer 3*a* are hidden from the exterior of the card 10C, therefore improving the appearance of the card 10C. Moreover, positions of the seams 60 between the transparent sheet 2*b* and the layer 3*c* are different from those of the seams 50 in contrast with the card 10B illustrated in FIG. 5. From this reason, the strength of the card 10C can be improved and a highly reliable ID card can be obtained.

Figure 7:
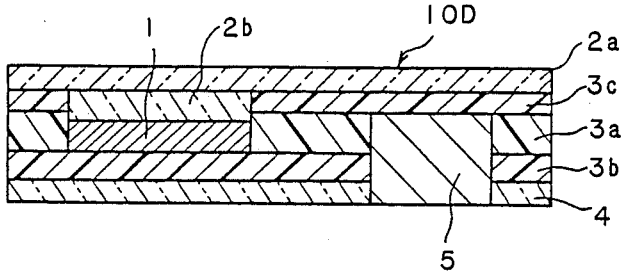
FIG. 7 is a sectional side view showing an identification card with an embedded photograph and which also contains an integrated circuit module according to the present invention.

FIG. 7 is a sectional side view showing an ID card according to the fourth embodiment of the present invention. In FIG. 7, an IC (integrated circuit) module 5 is built into an ID card 10D. The ID card 10D is one example of applying the present invention to an IC card, and is essentially the same as the ID card 10B illustrated in FIG. 5 except for the inclusion of the IC module 5. The thickness of the core layer 3*a* and 3*b*, the transparent sheet 2*b* or of other members can be selected according to requirements in the art.

In the above-mentioned ID card 10D, the same effects as in the card 10B illustrated in FIG. 5 can be obtained.

In the above-mentioned embodiments of the present invention, the ID cards are composed of five layers, however, other numbers of layers can also be used if the photograph is embedded generally in the center of the thickness of ID card.

While presently preferred embodiments of the present invention have been shown and described herein, it will be apparent to those skilled in the art that various changes and/or modifications thereof can be made without departing from the spirit and scope of the invention as defined in the appended claims.

What is claimed is:

1. An identification card comprising:

a core layer having a thickness, opposed upper and back surfaces, and an opening extending through the thickness of the core layer;

a photograph disposed in the opening in said core layer, said photograph having a predetermined size and substantially the same thickness as said core;

a first assembly of multiple layers laminated on said upper surface of said core layer and said photograph, said first assembly being transparent opposite at least part of said photograph; and a second assembly of multiple layers laminated on said back surface of said core layer and said photograph, said layers of said first and second assemblies having substantially similar thermal expansion properties and being substantially symmetrically arranged with respect to said photograph and said core layer.

2. An identification card as claimed in claim 1 wherein the opening is substantially equal to the size of said photograph.

3. An identification card as claimed in claim 1 wherein said first assembly includes a first transparent sheet directly laminated on the upper surface of said core layer and a transparent surface sheet directly laminated on said first transparent sheet opposite said core layer.

4. An identification card as claimed in claim 1 wherein said photograph has edges and said first assembly includes an opaque sheet including a transparent portion directly laminated on the upper surface of said core layer so that said transparent portion overlies a part of said photograph inside the edges and a transparent surface sheet directly laminated on said opaque sheet including a transparent portion.

5. An identification card as claimed in claim 4 wherein said transparent portion is smaller in size than said photograph so that said opaque sheet obscures the edges and part of said photograph.

6. An indentification card as claimed in claim 1 wherein said second assembly includes an opaque sheet laminated on the back surface of said core layer.

7. A identification card as claimed in claim 1 wherein said second assembly includes an opaque sheet laminated on the back surface of said core layer and a back sheet laminated on said opaque sheet opposite said core layer.

8. An identification card as claimed in claim 1 further including an integrated circuit module embedded in said card and extending through one of said assemblies.

* * * * *